US006357952B1

(12) United States Patent
McKeown

(10) Patent No.: US 6,357,952 B1
(45) Date of Patent: Mar. 19, 2002

(54) TWO-UP LOOSE-LEAF BINDER COVERS

(75) Inventor: Richard K. McKeown, Crawfordsville, IN (US)

(73) Assignee: Crawford Industries, LLC

( * ) Notice: Subject to any disclaimer, the term of this patent is extended or adjusted under 35 U.S.C. 154(b) by 0 days.

(21) Appl. No.: 09/289,075

(22) Filed: Apr. 8, 1999

(51) Int. Cl.[7] ..... B42F 13/00

(52) U.S. Cl. ..... 402/79; 83/934; 281/29; 402/73; 412/2; 493/355

(58) Field of Search ..... 493/947, 324, 493/354, 355; 402/70, 73, 79; 281/29, 36, 37; 29/432–557, 527.6; 83/934, 917, 237, 50

(56) References Cited

U.S. PATENT DOCUMENTS

| | | | | | |
|---|---|---|---|---|---|
| 718,827 | A | * | 1/1903 | Deydier | |
| 834,372 | A | * | 10/1906 | Dunham | 10/6 |
| 1,744,026 | A | * | 1/1930 | Baltzley | |
| 1,831,374 | A | * | 11/1931 | Tpopping | |
| 1,942,025 | A | * | 1/1934 | Frost | 148/16 |
| 2,454,609 | A | * | 11/1948 | Miller | 164/18 |
| 2,524,259 | A | * | 10/1950 | Hildmann | |
| 2,651,363 | A | * | 9/1953 | Hooe | 164/11 |
| 2,655,212 | A | * | 10/1953 | Stewart | 164/22 |
| 2,852,275 | A | * | 9/1958 | Brook | 281/31 |
| 3,088,753 | A | * | 5/1963 | Sendor | 281/29 |
| 3,167,328 | A | * | 1/1965 | Dengle et al. | 281/29 |
| 3,168,424 | A | * | 2/1965 | Sendor | 83/917 |
| 3,198,048 | A | * | 8/1965 | Finlayson et al. | 83/237 |
| 3,201,145 | A | * | 8/1965 | Libby | 281/29 |
| 3,207,017 | A | * | 9/1965 | McCain | |
| 3,570,356 | A | * | 3/1971 | Williams et al. | 83/693 |
| 3,642,963 | A | * | 2/1972 | Martelli et al. | 264/37 |
| 3,693,486 | A | * | 9/1972 | Maniaci et al. | 83/88 |
| 3,841,182 | A | * | 10/1974 | Cosgrove et al. | 83/89 |
| 4,023,264 | A | * | 5/1977 | Schmidt, Jr. | 29/610 |
| 4,102,482 | A | * | 7/1978 | Ruegsegger | 228/170 |
| 4,307,972 | A | * | 12/1981 | Errichiello | 281/35 |
| 4,317,399 | A | * | 3/1982 | Romagnoli | 83/237 |
| 4,395,929 | A | * | 8/1983 | Moser | 83/686 |
| 4,494,432 | A | * | 1/1985 | Kogane | 83/559 |
| 4,600,346 | A | * | 7/1986 | Podesek | 412/3 |
| 5,019,314 | A | * | 5/1991 | Burlando | 264/156 |
| 6,106,015 | A | * | 8/2000 | Udwin et al. | 281/29 |

* cited by examiner

*Primary Examiner*—A. L. Wellington
*Assistant Examiner*—Monica S. Carter
(74) *Attorney, Agent, or Firm*—Katten Muchin Zavis

(57) ABSTRACT

A two-up process for manufacturing one-piece binder covers including the steps of cutting a panel having opposed pairs of parallel sides; perforating the panel between two of its parallel sides to form a separating line to provide two rectangles connected together by the separation line; forming a recess at each end of the separation line so that each of the two rectangles has rounded corners upon separation of the two rectangles; dividing the blank by at least one pair of fold lines perpendicular to the perforated separation line and separating the blank into two binder covers each having four rounded corners.

10 Claims, 3 Drawing Sheets

TWO-UP LOOSE-LEAF BINDER COVERS

FIELD OF THE INVENTION

This invention relates generally to binders for holding an accumulation of hole-punched pages of ruled or unruled paper of the type used by school students and office personnel. In a more specific aspect the invention pertains to a process for fabricating a flat, relatively rigid, polyolefin sheet for use by binder producers. In still another of its aspects the invention provides a blank for use in fabricating one-piece loose-leaf binder covers by a two-up process which minimizes the fabrication steps required of binder manufacturers.

BACKGROUND OF THE INVENTION

It has become the practice of discount merchandisers and others distributing school supplies and office supplies to offer reasonably priced plastic binders along with the inexpensive ruled or unruled notebook paper which is widely used in schools at all levels for note taking purposes as well as storing records in offices. A variety of such binders are known in the art for holding an accumulation or collection of pages for student and business use. These binders can generally be divided into three major classes: those with snap ring binding mechanisms; those with adjustable height stud type binders; and the folding stud or post type of binder mechanism, the binder mechanism being the paper holding device which is secured to the back or edge panel within the binder. The back, or edge, panel is usually termed a spine. Still another type of binder mechanism employs a pressure clamp.

Probably the most widely used binding mechanism is the snap ring binding mechanism in which sets of two generally semicircular fingers, which are spring loaded and mounted to a metal base, can be closed to produce a substantially circular ring which passes through holes punched in the edges of the binder paper. There is usually one such ring for each hole punched in the binder paper.

It will be appreciated that binders with leather and plastic covers surrounding stiff cardboard front, rear and spine panels are relatively expensive due to the cost of construction. As illustrated in such patents as U.S. Pat. Nos. 4,307,972 and 5,878,946 the trend is to cut the cost of the item by utilizing plastic binder covers. As described in U.S. Pat. No. 5,618,122, even the ring binding mechanism of the binder may be fabricated using plastics. The trend, then, is to provide an inexpensive binder through the use of one-piece plastic cover fabrication processes. To this end a blank is provided for use by binder fabricators or converting companies. In the past such companies have purchased partially fabricated thermoplastic panels and by cutting and scoring have made one-piece binder covers in which they could install the paper-holding ring binding mechanism.

This invention provides improvements in the blank forming process in a manner not revealed in the known prior art.

SUMMARY OF THE INVENTION

This invention provides blanks and a process to facilitate manufacturing a looseleaf binder. It is an object of the invention to reduce the number of processing steps required of the converting companies, thereby lowering the cost of fabrication of binders. An additional object of the invention is to provide a binder material which can be readily decorated by screen printing and the like. Still another object of the invention herein is to provide a simple, inexpensive, looseleaf binder for holding the binding mechanism and the sheets of paper and the like, therein, having holes punched at a specific spacing along one edge. It is a further object of the invention to provide binders having unitary plastic covers of various thicknesses with pre-scored fold or hinge lines which permit folding of the front and rear covers relative to the spine.

This invention pertains to a two-up process for manufacturing one-piece covers for loose-leaf binders or notebooks which removably receive and hold hole-punched binder paper sheets. The binder cover is fabricated from a panel or blank of an extruded polyolefin material. The blank is cut in the shape of a quadrilateral having perpendicular adjacent sides providing opposed pairs of parallel sides. In other words the blank is a rectangular or square sheet of plastic having opposed parallel sides. Midway between two of its parallel sides the blank is perforated to form a separation line resulting in two rectangles connected together by the perforated separation line. A recess is cut in the blank at each end of the perforated separation line resulting in two rectangles each having four exposed corners. The rectangles thus each have one long peripheral edge and two short peripheral edges, with the other long peripheral edges of each rectangle being formed upon separation of the two rectangles along the perforation line. Prior to separation the four exposed corners of each of the two rectangles are rounded off. At least one pair of fold or hinge lines perpendicular to the perforated separation line is formed across the rectangles to define equally sized front and rear binder panels and a smaller spine panel between them in the form of a binder back panel for attachment thereto of a paper holder which will hold the pages of paper. Typically, the holder will provide a three-ring binding mechanism.

These and other objects and advantages, as well as the invention itself, will become more apparent if the invention is summarized and described in greater detailed by reference to drawings.

DETAILED DESCRIPTION OF THE INVENTION

Figures 1, 2, 3:
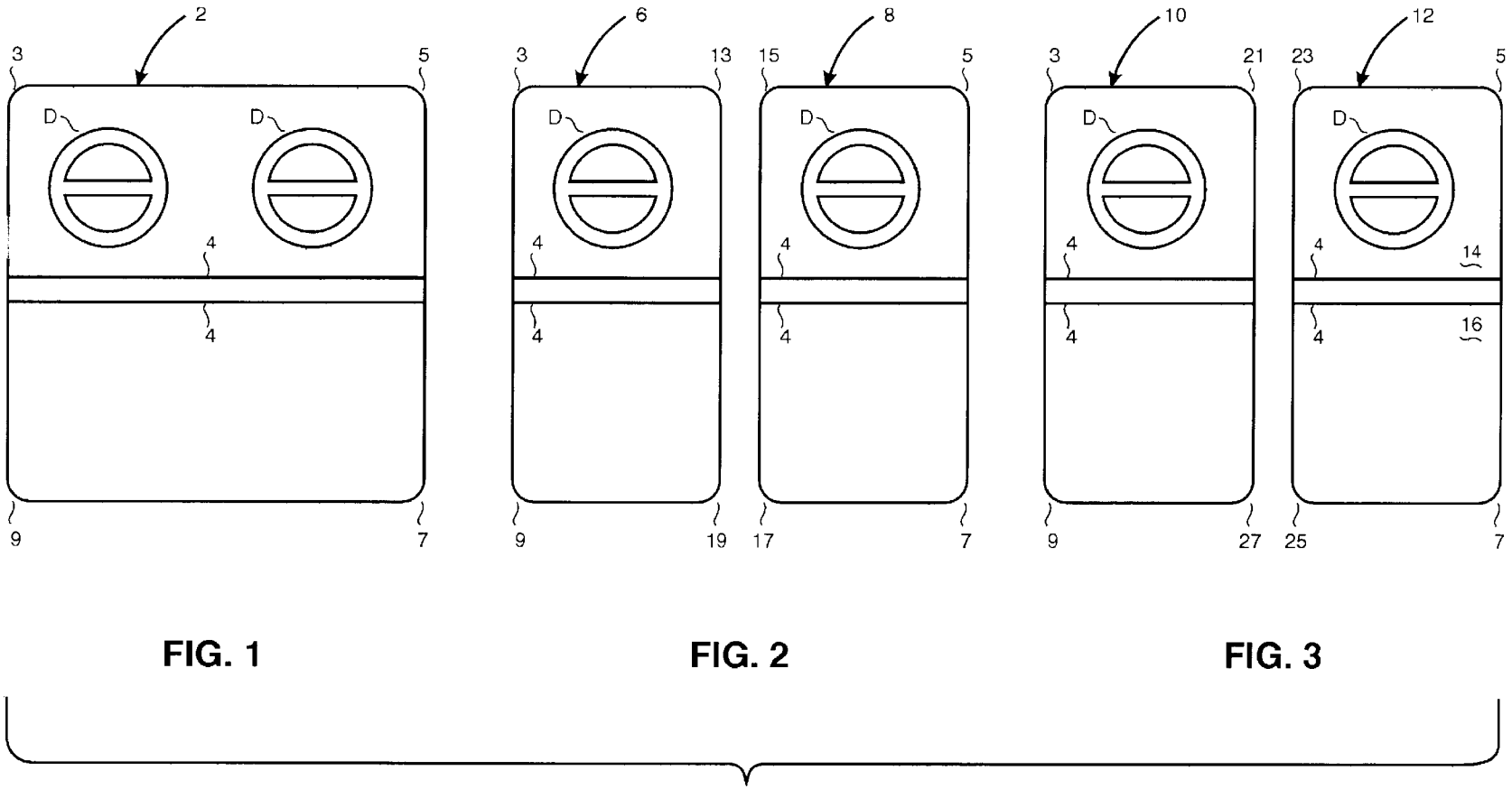
FIG. 3 PRIOR ART
FIG. 1 is a plan view of a prior art binder blank currently being shipped to fabricators of looseleaf binders.
FIG. 2 is a plan view showing resulting scored rectangular corners of panels which are formed when the blank illustrated in FIG. 1 is divided.
FIG. 3 is a plan view of the finished binder covers, ready for attachment of a paper ring binding mechanism.

Represented in FIG. 1 is a prior art blank 2 now in commercial use. This blank is supplied to binder manufacturers in the form shown, and is intended for use in the fabrication of two binder covers. Blank 2 is provided as a molded plastic panel and, except for the front cover decoration, for example, as indicated by D, the blank 2 is sent to the manufacturer in the form shown in FIG. 1, with a pair of score lines 4 and four rounded corners 3, 5, 7, and 9. It remains for the manufacturer or convertor to fabricate two binder covers from binder blank 2. Binder fabricators prefer blanks capable of providing two binder covers (sometimes referred to as two-up) to reduce printing or silk screening costs by printing and/or decorating both binder covers in one run. After decorating the panel, as with decoration D, then, the manufacturer must cut blank 2 of FIG. 1 to produce two decorated intermediate blanks 6 and 8. First he must measure and cut the blank in half as with a guillotine. Then he must round four more corners at the ends of the cut line by die cutting or otherwise. As seen in FIG. 2 when blank 2 is cut in half, square corners 13, 15, 17 and 19 remain and must be subsequently rounded off. The desired end binder covers 10 and 12 are illustrated in FIG. 3. Each of these binder covers 10 and 12 has rounded corners 21, 23, 25 and 27 as well as fold lines 4. The fold lines define equally sized front and rear binder panels 14 and 16 respectively, and a smaller spine panel 18 between them. Panel 18 is in the form of a binder spine for attachment of a three ring binding mechanism 30, see FIG. 6, which will hold the pages of paper. The three major classes of binders have been discussed hereinbefore, the preferred binding mechanism being a snap ring mechanism. After attachment of the ring binding mechanism, the binder covers 10 and 12 can be folded along fold lines 4, to form a finished binder.

Figure 4:
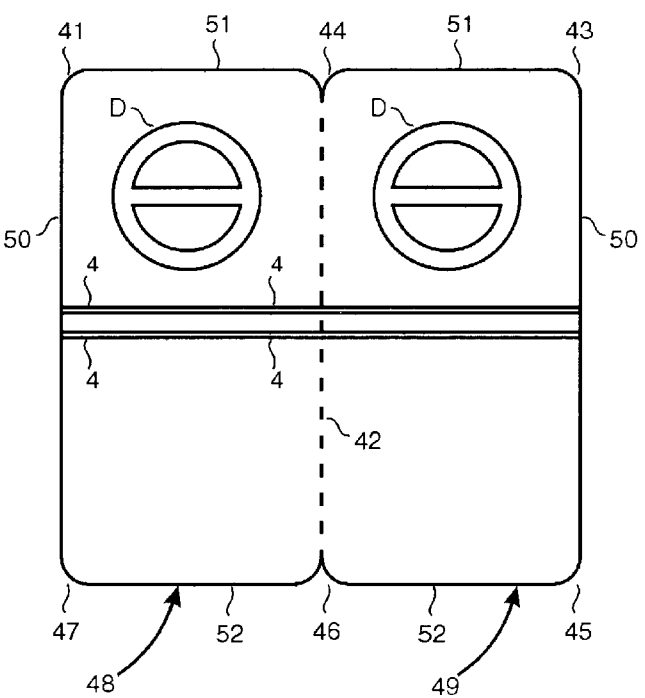
FIG. 4 is a plan view illustrating a binder cover blank provided by this invention.

Referring now to the invention, shown in FIGS. 4–8, it can now be shown how the process of this invention produces significant cost and labor savings by the provision of a novel blank 40 in FIG. 4. It has been found that polyolefins can be more readily decorated by silk screening and similar processes. Accordingly blank 40 of the invention is preferably made using a polyethylene or a polypropylene panel, preferably a high density polymer, ranging in thickness from a gauge of about 0.020 to about 0.075 gauge having four corners 41, 43, 45 and 47.

As illustrated in FIG. 4 there are two significant features not seen in prior art FIG. 1. The first feature is a perforated separation line 42. The addition of perforated separation line 42 eliminates the cutting operation referred to in conjunction with FIG. 2.

Figure 5:
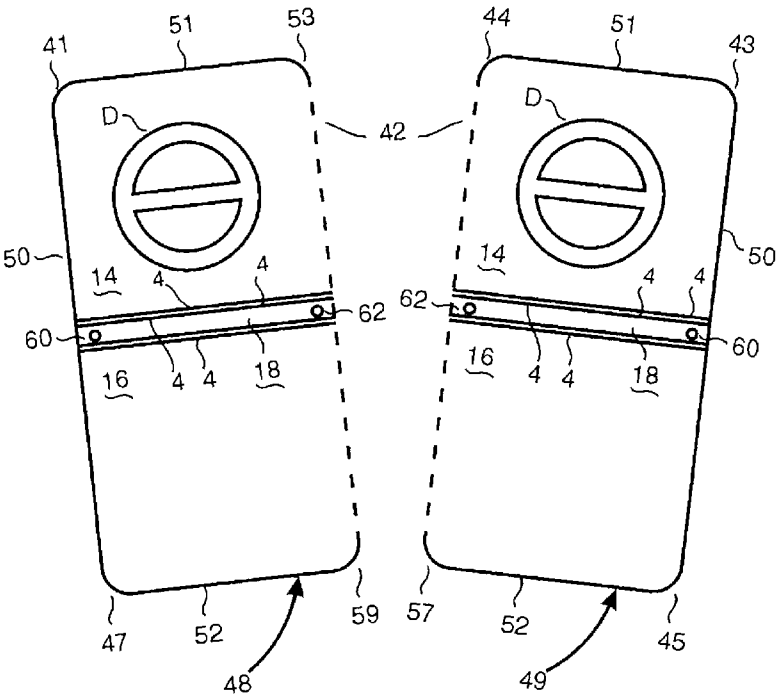
FIG. 5 is a plan view showing the scored rectangular panels which are obtained when the blank illustrated in FIG. 4 is torn along its perforated separation line.
Figure 8:
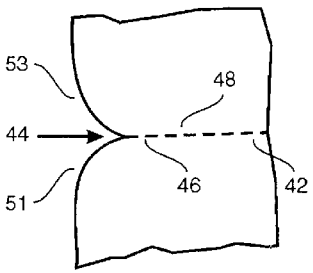
FIG. 8 is an enlarged view of the recess formed at the end of the perforated separation line.

The second, and equally important, feature of the invention is the provision of notches or recesses 44 and 46 which are more particularly illustrated in FIG. 4, making it possible to produce the binder covers according to the invention. Recesses 44 and 46 in blank 40 at each end of perforated separation line 42 make it possible to process the four corners 53, 55, 57, and 59 before the blank is shipped to the manufacturer. In addition, the recesses 44 and 46 act as a starter for the perforated separation line, as best shown in FIG. 8. It can be seen that these desiderata completely eliminate the cutting and corner rounding operations described in conjunction with FIGS. 2 and 3. Perforated separation line 42, and the rounding of corners 53, 55, 57, and 59 result in two rectangles 48 and 49 each having one long peripheral edge 50, and two short peripheral edges 51 and 52, with the other long peripheral edges of each rectangle being formed upon separation of the two rectangles along perforation line 42 as shown in FIG. 5. When separated along perforated separation line 42 the two rectangles are ready for use by the fabricator or convertor. It can be seen that they carry rounded corners, and also fold lines 4 defining equally sized front and rear binder panels 14 and 16 respectively. Although conventional single score lines may be used, the provision of double score lines is preferred.

Figure 7:
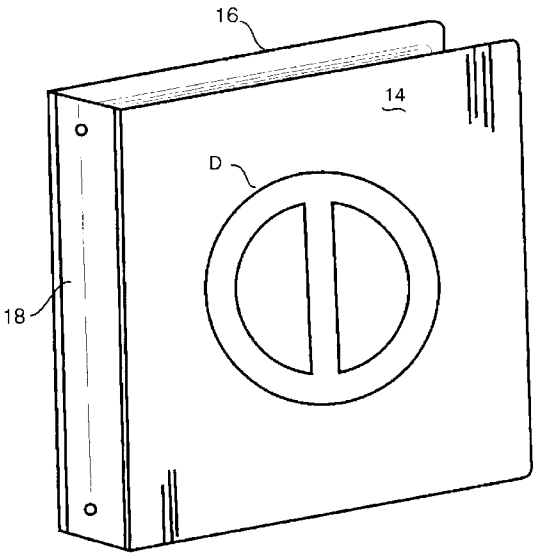
FIG. 7 is an isometric view of one of the two completed or finished binders.
Figure 6:
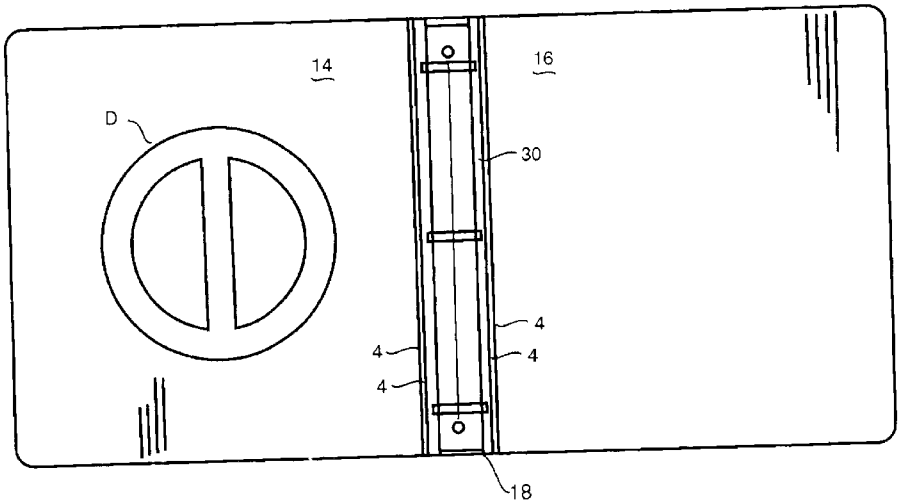
FIG. 6 is a plan view of a binder showing the ring binding mechanism.

Further, a smaller spine panel 18 is provided between the fold lines to serve as a binder spine panel for attachment of a ring binder mechanism 30 which will hold the pages of paper. Binder covers 48 and 49 thus resemble the final structure shown in FIG. 3, but they eliminate costly and time consuming operations described with reference to FIG. 2. In the preferred embodiment, when the ring binding mechanism 30 is attached to spine 18, as shown in FIG. 6, and the binder is closed it will appear as shown in FIG. 7.

As shown in FIG. 8, the perforated separation line 42 has a first perforation 48 spaced from the recess 44 by material portion 46. This arrangement provides that while easy to tear, the blank 2 may be maintained as a single sheet to facilitate application of the decoration D prior to separation.

Having been given the teachings of this invention ramifications and variations will occur to those skilled in the art. Thus, as a further savings for the fabricator pre-punched holes 60 and 62 can be provided in binder spine panel 18 as shown in FIG. 5 for attaching the ring binding mechanism 30. In addition in lieu of one fold line in each pair, two fold lines or double scores can be substituted for single fold lines 4 shown in FIG. 1. The additional fold lines render the binder less likely to a tendency to open when laying flat with no weight on it. Such modifications are deemed to be within the scope of this invention.

What is claimed is:

1. A process for manufacturing blanks for making a pair of detachable one-piece loose-leaf binder covers the process comprising the steps of:

(a). cutting a blank in the shape of a first quadrilateral panel defining two opposed pairs of sides;

(b). perforating said first quadrilateral panel between two of its sides forming a separation line defining second and third quadrilateral panels connected together by said perforated separation line;

(c). cutting a recess in said first quadrilateral panel at each end of said perforated separation line so that each of said second and third quadrilateral panels has four corners; and (d). forming at least one pair of fold lines in each of said second and third quadrilateral panels, said pairs of fold lines spaced away from perforated separation line to define front and rear binder panels, and a smaller spine panel therebetween.

2. The process as recited in claim 1, wherein the recess is shaped to provide the rounded corners at each end of the separation line.

3. The process as recited in claim 1 wherein the four corners of each rectangle are die cut.

4. The process as recited claim 1, wherein the fold lines are in the form of double scores.

5. The process as recited claim 1, wherein the two rectangles are decorated prior to separation.

6. A polyolefin blank for a pair of one-piece loose-leaf binders which removably receive and hold hole-punched binder paper sheets, the blank comprising:

a first quadrilateral panel having four sides defining two opposed pairs of sides;

a perforated separation line formed between two of its sides forming second and third quadrilateral panels connected together by said perforated separation line;

a recess formed at each end of the perforated separation line so that each of said second and third quadrilateral panels has four corners; and at least one pair of fold lines in each of said second and third quadrilateral panels defining front and rear binder panels and a smaller spine panel therebetween, said spine panel for attachment of a binding mechanism for holding pages of paper.

7. The blank as recited in claim 6, wherein the recess is shaped to provide the rounded corners at each end of the separation line.

8. The blank as recited in claim 6, wherein the quadrilateral panel four corners are die cut.

9. The blank as recited claim 6, wherein the fold lines are in the form of double scores.

10. The blank as recited in claim 6, wherein the two rectangles are decorated prior to separation.

* * * * *